US006086407A

United States Patent [19]

Daoud

[11] Patent Number: 6,086,407

[45] Date of Patent: Jul. 11, 2000

[54] TERMINAL DESIGN FOR IMPROVED DIELECTRIC STRENGTH

[75] Inventor: Bassel H. Daoud, Parsippany, N.J.

[73] Assignee: Lucent Technologies Inc., Murray Hill, N.J.

[21] Appl. No.: 09/218,066

[22] Filed: Dec. 21, 1998

[51] Int. Cl.[7] ..... H01R 4/24

[52] U.S. Cl. ..... 439/405; 439/417

[58] Field of Search ..... 439/395, 396, 439/398, 400, 404, 405, 408, 409, 417, 733.1, 751

[56] References Cited

U.S. PATENT DOCUMENTS

| | | | |
|---|---|---|---|
| 3,611,264 | 10/1971 | Ellis | 439/403 |
| 3,636,500 | 1/1972 | Sedlacek | 439/395 |
| 4,260,212 | 4/1981 | Ritchie et al. | 439/395 |
| 4,288,141 | 9/1981 | Leather | 439/395 |
| 4,421,374 | 12/1983 | Montilla, Jr. et al. | 439/408 |
| 4,641,904 | 2/1987 | Kosugi et al. | 439/404 |
| 4,662,699 | 5/1987 | Vachhani et al. | 439/395 |
| 4,793,823 | 12/1988 | Cozzens et al. | 439/409 |
| 4,909,754 | 3/1990 | Paradis | 439/395 |
| 4,960,389 | 10/1990 | Frantz et al. | 439/404 |
| 5,240,432 | 8/1993 | Daoud | 439/417 |
| 5,533,910 | 7/1996 | Körner et al. | 439/404 |
| 5,556,296 | 9/1996 | Dussausse et al. | 439/404 |
| 5,637,011 | 6/1997 | Meyerhoefer et al. | 439/409 |
| 5,860,829 | 1/1999 | Hower et al. | 439/417 |

FOREIGN PATENT DOCUMENTS

| | | | |
|---|---|---|---|
| 0204184 | 11/1983 | Germany | 439/395 |

OTHER PUBLICATIONS

Technical Data Sheet of A.C. Egerton Limited, related to Mini Rocker Cross Connection Cabinets.

*Primary Examiner*—Hien Vu
*Assistant Examiner*—Tho D. Ta
*Attorney, Agent, or Firm*—Stroock & Stroock & Lavan LLP

[57] ABSTRACT

A connector having improved dielectric strength that includes body having a first side and an opposing second side. A first terminal is disposed in the body, the first terminal having a first terminal strip portion with a center. A first wire-wrap tail is connected to the first terminal strip portion at a position that is offset from the center of the first terminal strip portion and toward the first side of the body. A second terminal is disposed in the body, the second terminal having a second terminal strip portion with a center. A second wire-wrap tail is connected to the second terminal strip portion at a position that is offset from the center of the second terminal strip portion and toward the second side of the body.

7 Claims, 3 Drawing Sheets

TERMINAL DESIGN FOR IMPROVED DIELECTRIC STRENGTH

FIELD OF THE INVENTION

This invention relates to a connector and, in particular, to a connector with a terminal design for providing improved dielectric strength.

BACKGROUND OF INVENTION

In a telephone network, a network cable from the central office is connected to a building entrance protector (BEP) located at the customer site, where the individual telephone lines are broken out line by line. The network cable, which consist of a plurality of tip-ring wire pairs that each represent a telephone line, is typically connected to a connector block that is an integral part of the BEP. Such connectors may be, for example, the ubiquitous 66-type punch down connector, or SC 99 type connector block, such as are available from Lucent Technologies Inc., or a mini-rocker type connector, also known in the art, and sold by A.C. Egerton, Ltd.

A connector generally has a movable top section which comprises two wire insertion holes and a lower fixed section which houses a pair of terminal. The top movable section pivots about a pivot point located towards back side of the connector. The top section has a movable latch member to maintain the top section in its closed position. To open the top section, a user releases latch member and pivots the top section around the pivot point to its open position.

When the top section is open, the terminal strips do not intersect the wire insertion holes, and when the top section is closed, the terminal strips intersect the wire insertion holes. In order to establish an electrical connection between the wires and the terminal strips a user first opens the top section, i.e., pivots the top section to its open position, inserts the pair of wires, and then closes the top section. Upon closing the top section of the connector, the wires are brought into electrical contact with the terminal strips. To remove the wires and/or break the electrical connection, the process is reversed.

Referring now to FIGS. 1 and 1A, there is shown a prior art connector 10 including a pair of terminals 28*a*,28*b*. Each terminal 28*a*,28*b* includes a terminal strip portion 30*a*,30*b*, respectively, used for attaching a wire to connector 10. A wire-wrap tail 29*a*,29*b* is connected to the center of the base of terminal strip portion 30*a*,30*b*, respectively. Each of wire-wrap tails 29*a*,29*b* must be electrically isolated from the other, as these portions of the terminal strip will always necessarily extend beyond the plastic insulating body of the connector to provide access by the wire wrap tool used to connect a wire to the terminal strip.

Generally, the space S between wire-wrap tails 29*a* and 29*b* should be sufficient enough to achieve acceptable dielectric performance. Yet, as high density within any wiring location is generally desired, it may be desirable to reduce the size of connector 10 so that more connectors can be used within a given area. However, in order to reduce the size of connector 10, the distance between terminals 28*a* and 28*b* must also be reduced, which will result in the reduction of the dielectric strength between wire-wrap tails 29*a* and 29*b* to unacceptable levels.

SUMMARY OF THE INVENTION

The present invention is directed at overcoming shortcomings in the prior art. In accordance with the present invention, a connector having improved dielectric strength is provided wherein the connector includes body having a first side and an opposing second side. A first terminal is disposed in the body, the first terminal having a first terminal strip portion with a center. A first wire-wrap tail is connected to the first terminal strip portion at a position that is offset from the center of the first terminal strip portion and toward the first side of the body. A second terminal is disposed in the body, the second terminal having a second terminal strip portion with a center. A second wire-wrap tail is connected to the second terminal strip portion at a position that is offset from the center of the second terminal strip portion and toward the second side of the body. Because the distance between the wire-wrap tails is increased, the strength of the dielectric between the wire-wrap terminals is also increased thereby improving the performance of the connector. Alternatively, the terminal design of the present invention may be used to reduce the size of the connector by mounting the terminals closer to each other within the connector body while retaining a sufficient distance between the wire-wrap tails to maintain acceptable dielectric strength.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

BRIEF DESCRIPTION OF THE DRAWINGS

In the drawing figures, which are not to scale, and which are merely illustrative, and wherein like reference numerals depict like elements throughout the several views.

DESCRIPTION OF A PREFERRED EMBODIMENT

Figure 1:
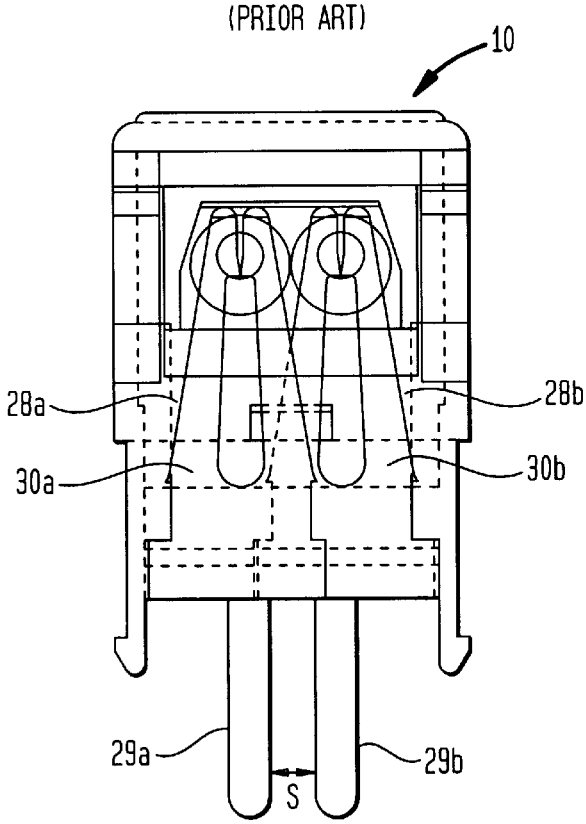
FIG. 1 (PRIOR ART)
FIG. 1 is a front view of a prior art connector.
Figure 1A:
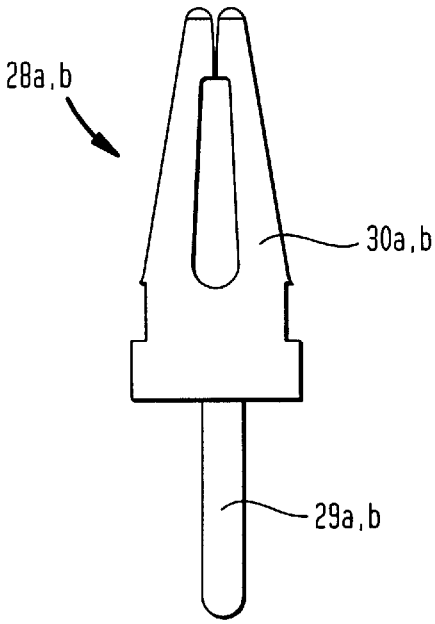
FIG. 1A (PRIOR ART)
FIG. 1A is a front view of a prior art terminal strip.
Figure 2:
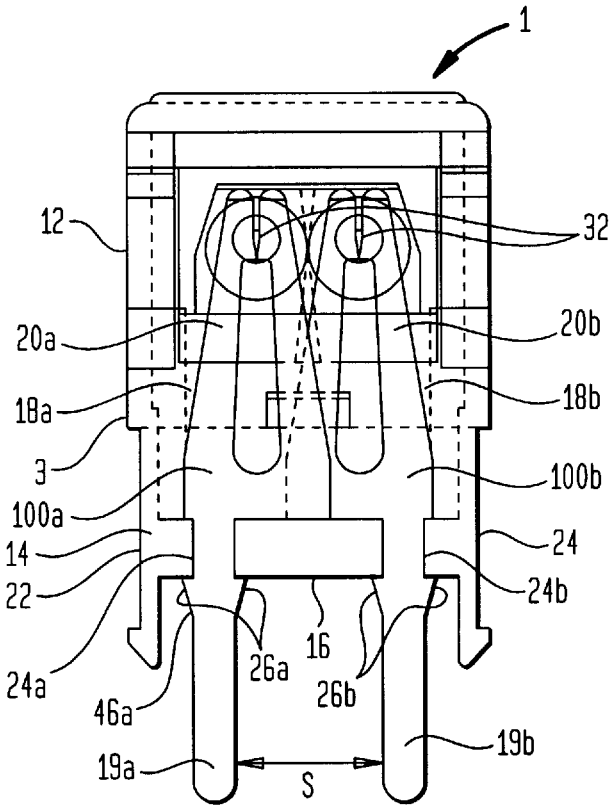
FIG. 2 is a front view of a connector constructed in accordance with a first embodiment of the present invention.
Figure 3:
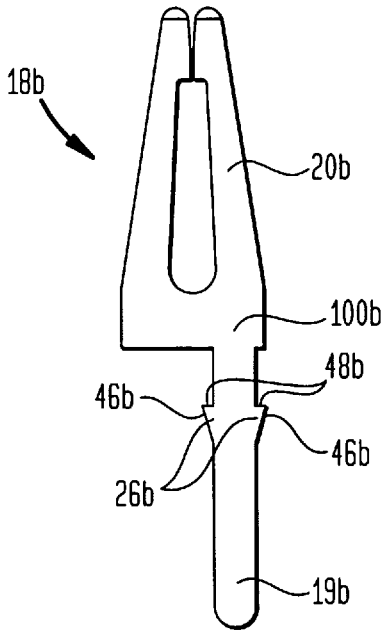
FIG. 3 is a front view of a terminal used in the connector of FIG. 2 in accordance with he present invention.

Referring now to FIGS. 2–3, there is shown a connector 1 constructed in accordance with a first embodiment of the present invention. According to the first embodiment, connector 1 includes a body 3 having an upper section 12, a lower section 14 a first side 22 and an opposing second side 24. Upper section 12 includes two wire insertion holes 22 for receiving wires. A pair of terminals 18*a*,18*b* are disposed in lower section 14. Each of terminals 18*a*,18*b* includes a terminal strip portion 20*a*,20*b*, respectively, used for attaching a wire to connector 1 that is received through wire insertion holes 32. A first wire-wrap tail 19*a* is connected to the base 100*a* of terminal strip portion 20*a* at a point that is offset from the center of terminal strip portion 20*a* toward first side 22 of connector 1. A second wire-wrap tail 19*b* is connected to the base 100*b* of terminal strip portion 20*b* at a point that is offset from the center of terminal strip portion 20*b* toward second side 24 of connector 1. Because wire-wrap tails 19*a*,19*b* are connected to corresponding terminal strip portions 20*a*,20*b* at a point that is offset from center, the space S between wire-wrap tails 19*a* and 19*b* is increased thereby increasing the dielectric strength between wire-wrap tails 19*a* and 19*b*. It will be recognized from FIG. 3 that although terminal strip 20*b* is depicted in that figure, the figure relates also to strip 20*a*. In other words the terminal strips 20*a, b* are physically of the same structure as that depicted in FIG. 3, the only difference being how the terminal strip is positioned within the connector. The same applies to FIG. 5.

The present invention can also be used to effect a reduction in the size of connector 1. The size of connector 1 can be reduced by moving terminals 18*a* and 18*b* closer to each other within body 14 of connector 1. The dielectric strength between wire-wrap tails 19*a* and 19*b* will be maintained by offsetting wire-wrap tails 19*a*,19*b* with respect to terminal strip portions 20*a*,20*b*, respectively, as described above, thereby maintaining acceptable dielectric performance between wire-wrap tails 19*a* and 19*b*.

The connector of the first embodiment also includes a base wall 16 having two wire-wrap tail openings 24*a*,24*b* disposed therein. Each of wire-wrap tails 19*a*,19*b* includes a pair of barbs 26*a*,26*b*, respectively, that extend outwardly from wire-wrap tails 19*a*,19*b*. Each barb 26*a*,26*b* includes a sloped portion 46*a*,46*b* and a perpendicular portion 48*a*,48*b*, respectively. The size of each barb 26*a*,26*b* is such that the combination of each barb 26*a*,26*b* and each wire-wrap tails 19*a*,19*b*, respectively, is slightly wider than the width of wire-wrap tail openings 24*a*,24*b*. In an exemplary embodiment, barbs 26*a*,26*b* are approximately 15 mm. Thus when terminals 18*a*,18*b* are inserted into body 14 during assembly, wire-wrap tails 19*a*,19*b* extend through wire-wrap tail openings 24*a*,24*b* until barbs 26*a*,26*b* reach wire-wrap tail openings 24*a*,24*b*, respectively. Next, with the application of minimal insertion force, sloped portions 46*a*, 46*b* of each barb 26*a*,26*b*, respectively, slightly spread open wire-wrap tail openings 24*a*,24*b* thereby allowing wire-wrap tails 19*a*,19*b* to be fully seated within body 14. Once wire-wrap tails 19*a*,19*b* are fully-seated, terminals 18*a*,18*b* can no longer be dislodged towards the top portion 12 of connector 1 due to the abutment of perpendicular portions 48*a*,48*b* of barbs 26*a*,26*b*, with the perimeter of openings 24*a*,24*b* respectively. As a result, terminals 18*a*,18*b* remain properly seated even when top portion 12 of connector 1 is opened when wires are connected to terminal strips 20*a*,20*b*.

Figure 4:
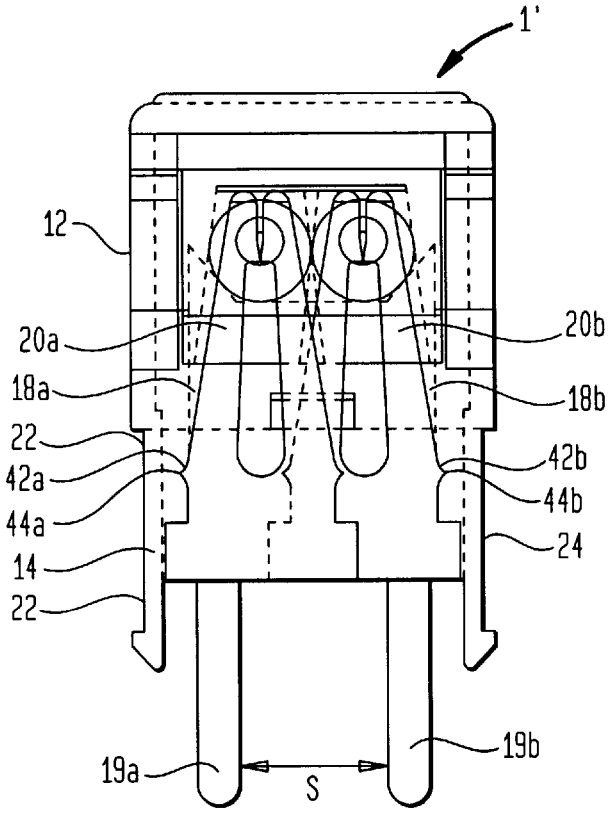
FIG. 4 is a front view of a connector constructed in accordance with a second embodiment of the present invention.
Figure 5:
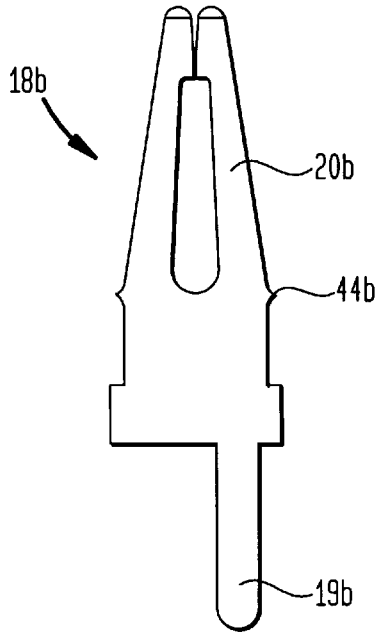
FIG. 5 is a front view of a terminal used in the connector of FIG. 4.

Referring now to FIGS. 4–5, there is shown a connector 1' according to a second embodiment of the present invention. Elements that are the same as elements in the first embodiment are similarly labeled and a detailed description thereof will be omitted.

In this embodiment, each terminal strip 20*a*,20*b* include a barb 44*a*,44*b*, respectively. A low interference hole 42*a* is embedded on the inside portion of body 14 adjacent side 22. A low interference hole 42*b* is embedded on the inside portion of body 14 adjacent side 24. Low interference holes 42*a* and 42*b* are positioned so that when terminals 18*a* and 18*b* are inserted in body 14, barbs 44*a*,44*b* become lodged in holes 42*a*,42*b*, respectively. Once terminals 18,18*b* are fully inserted, they are fixed in their proper position because of barbs 44*a*,44*b* being lodged in holes 42*a*,42*b*, respectively. Thus, terminals 18*a*,18*b* no longer move towards the top portion 12 of connector as a result of top portion 12 of connector being opened when wires are connected to terminal strips 20*a*,20*b*. Due to the offset nature of wire wrap tails 19*a,b*, space S is likewise increased over the prior art in this embodiment as well.

In all embodiments, terminals 18*a*,18*b* may be formed by stamping or other common metal working technique, and made of any commonly known conductive metal known in the art and suitable for use in such terminals, such as, for example, platinum washed phosphor bronze, or beryllium-copper alloy or other metal or alloy combining good electrical conductivity with sufficient mechanical strength and resilience. Similarly, connectors 1,1' are preferably formed of a molded synthetic resinous material with good insulating properties and mechanical strength. The specific materials utilized in constructing connectors 1,1' are an application specific matter of design choice within the knowledge of the person of skill familiar with connectors utilized in the telephony art. Moreover, the specific means of affixing terminals 18*a*,18*b* within connector 1 or 1' may be of any of the numerous methods of affixation known in the art, such as snap fitting, adhesives, friction fitting, integral molding, and the like, depending on whether ready removal and re-insertion of the terminal is required, as a matter of application specific design choice.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A connector, comprising:

a body, said body having a first side and an opposing second side;

a first terminal disposed in said body, adjacent to said first side said first terminal having a first terminal strip portion with a first center, said first center being located closer to said first side than said second side of said body;

a first wire-wrap tail connected to said first terminal strip portion at a position being offset from said first center of said first terminal strip portion such that said first wire-wrap tail being disposed between said first side of said body and said first center;

a second terminal disposed in said body, adjacent to said second side said second terminal having a second terminal strip portion with a second center, said second center being located closer to said second side than said first side of said body; and, a second wire-wrap tail connected to said second terminal strip portion at a position being offset from said second center of said second terminal strip portion such that said second wire-wrap tail being disposed between said second side of said body and said second center.

2. The connector of claim 1, further comprising:

a cap section; and a base section, said cap section being movable between an open position and a closed position, said cap section having therein at least one wire insertion channel for guidedly receiving a wire, said channel having an entrance aperture for entry of said wire, said open position facilitating entry of said wire in said channel.

3. The connector of claim 2, further comprising a latch member movable between an engaged position and a disengaged position, said latch member maintaining said cap section in said closed position when said latch member is in said engaged position.

4. The connector of claim 2, wherein said channel further comprises a wire stop surface such that an extent of entry of said wire is limited by abutment with said wire stop surface.

5. The connector of claim 2, wherein said cap section includes a finger grip member for facilitating movement of said cap section from said open position to said closed position and vice versa.

6. The connector relief of claim 2, wherein said cap section and said base section are connected at a pivot point such that said cap section pivots about a living hinge.

7. A method of manufacturing a connector, comprising the steps of:

forming a body, said body having a first side and an opposing second side;

placing a first terminal in said body, adjacent to said first side said first terminal having a first terminal strip portion with a first center, said first terminal being placed with said first center being located closer to said first side than said second side of said body;

connecting a first wire-wrap tail to said first terminal strip portion at a position being offset from said first center of said first terminal strip portion such that said first wire-wrap tail being disposed between said first side of said body and said first center;

placing a second terminal in said body, adjacent to said second side said second terminal having a second terminal strip portion with a second center, said second terminal being placed with said second center being located closer to said second side than said first side of said body;

connecting a second wire-wrap tail to said second terminal strip portion at a position being offset from said second center of said second terminal strip portion such that said first wire-wrap tail being disposed between said second side of said body and said second center.

* * * * *